US007931340B1

(12) United States Patent
Reddick

(10) Patent No.: US 7,931,340 B1
(45) Date of Patent: Apr. 26, 2011

(54) TETRAFRAME COMPONENT OF FURNITURE

(76) Inventor: William T Reddick, Wellesley, MA (US)

( * ) Notice: Subject to any disclaimer, the term of this patent is extended or adjusted under 35 U.S.C. 154(b) by 414 days.

(21) Appl. No.: 12/014,012

(22) Filed: Jan. 14, 2008

(51) Int. Cl.
*A47C 7/00* (2006.01)
*A47C 17/00* (2006.01)

(52) U.S. Cl. ..... 297/452.18; 297/451.8; 297/440.14; 297/445.1; 297/452.1; 297/452.19; 297/452.21; 5/200.1; 52/653.1

(58) Field of Classification Search ..... 297/45, 297/184.1, 184.11, 184.15, 248, 16.2, 232, 297/159.1, 158.4, 173, 135, 451.1, 452, 1, 297/452.2, 452.3, 451.8, 440.8, 440.18, 440.14, 297/445.1, 452.1, 452.19, 452.21; 5/112, 5/114–117, 174–175, 176.1, 181–182, 184, 5/659, 200.1; 254/93
See application file for complete search history.

(56) References Cited

U.S. PATENT DOCUMENTS

| | | | | |
|---|---|---|---|---|
| 2,080,982 | A * | 5/1937 | MacDonald | 297/139 |
| 3,230,012 | A * | 1/1966 | Beckman et al. | 297/451.1 |
| 3,494,578 | A | 2/1970 | Cureton | |
| 4,446,666 | A | 5/1984 | Gilman | |
| 4,449,348 | A * | 5/1984 | Jacobs | 52/652.1 |
| 4,787,191 | A | 11/1988 | Shima | |
| 4,942,700 | A | 7/1990 | Hoberman | |
| 4,967,533 | A | 11/1990 | Weisse | |
| 5,267,776 | A | 12/1993 | Fromson | |
| 6,132,129 | A | 10/2000 | Frazier | |
| 6,231,119 | B1 | 5/2001 | Zheng | |
| 6,457,192 | B2 * | 10/2002 | Choi et al. | 5/114 |
| 6,711,761 | B2 * | 3/2004 | Choi | 5/114 |
| 7,114,205 | B2 * | 10/2006 | Choi | 5/114 |
| 7,604,289 | B2 * | 10/2009 | Chen | 297/159.1 |
| 7,648,196 | B2 * | 1/2010 | Degelman et al. | 297/45 |
| 2004/0000009 | A1 * | 1/2004 | Choi | 5/174 |
| 2004/0046428 | A1 * | 3/2004 | Hwang | 297/188.2 |

FOREIGN PATENT DOCUMENTS

| | | |
|---|---|---|
| EP | 0415597 | 6/1991 |
| GB | 1204245 | 9/1970 |
| GB | 1543419 | 4/1979 |

* cited by examiner

*Primary Examiner* — Jeanette E. Chapman
(74) *Attorney, Agent, or Firm* — Michael I. Krol

(57) ABSTRACT

A method of fabrication of furniture by affixing a plurality of rods of similar length forming a frame comprising a plurality of tetrahedra and pentahedra with the frame having at least one planar surface for attachment thereto of a covering.

22 Claims, 16 Drawing Sheets

TETRAFRAME COMPONENT OF FURNITURE

FIELD OF THE INVENTION

The present invention relates generally to furniture, and, more specifically, to articles of furniture comprising a plurality of rods of similar length forming a frame with at least one planar surface (bed, table, shelf, foot stools etc.) for coverings.

The present invention comprises of interconnection of rods forming both tetrahedron and pentahedron structures in unison. When a plurality of tetrahedron and/or pentahedron structures are interconnected, structures of furniture are formed. These forms are utilized as the frame structure for various furniture including, chairs, couches, tables, beds, shelving, lounge chairs and other different shapes of said forms of furniture, formed by addition or subtraction of individual rods, thus unlimited furniture forms.

When working with polyhedra structures, the tetrahedron/pentahedron components may be oriented with a triangle primary surface or a square primary surface. Where as when oriented with a triangle, the triangle is used as the working planar surface(s) such as a chair. Likewise, when oriented with a square, the square is used as the working planar surface such as an ottoman. These orientations are depicted in FIGS. 1, 2 and 3.

The connection of the distal end of each rod may be affixed permanently or semi-permanently. Welding or brazing is a preferred method of permanent rod interconnection. For semi-permanent or knockdown structures, fasteners or a node connector formed of fastenable mating members are used to secure the distal ends.

DESCRIPTION OF THE PRIOR ART

There are other gaming and entertainment systems. Typical of these is U.S. Pat. No. 3,494,578 issued to Cureton on Feb. 10, 1970.

Another patent was issued to Gilman on May 8, 1984 as U.S. Pat. No. 4,446,666. Yet another U.S. Pat. No. 4,787,191 was issued to Shima on Nov. 29, 1988 and still yet another was issued on Jul. 24, 1990 to Hoberman as U.S. Pat. No. 4,942,700.

Another patent was issued to Weisse on Nov. 6, 1990 as U.S. Pat. No. 4,967,533. Yet another U.S. Pat. No. 5,267,776 was issued to Fromson on Dec. 7, 1993. Another was issued to Frazier on Oct. 17, 2000 as U.S. Pat. No. 6,132,129 and still yet another was issued on May 15, 2001 to Zheng as U.S. Pat. No. 6,231,119.

Internationally, a United Kingdom patent was issued to Holt on Sep. 3, 1970 as Patent Number GB 1204245. Yet another United Kingdom Patent Number GB1543419 was issued to Holland on Apr. 4, 1979. A European Patent Application was issued to Weisse on Mar. 6, 1991 as Patent Application No. EPO415597.

A centroidally supported modular tetrahedron structure, particularly adapted for use in a kite including a plurality of tetrahedron shaped units. Each unit has four supporting struts which are attached at their one end at the centroid of the unit and extend to the apices of the tetrahedron. A sheet member or sail is disposed on two of the faces of the tetrahedron and is attached at the ends of the struts. Tension strings and/or sail tension edges connect the ends of the struts together and tend to force the struts toward the centroid. Some of the sail ends may be attached to their strut ends by elastic bands to provide for a variable effective sail area. The strut ends have connectors whereby a plurality of units may be joined together as desired to form a variety of overall kite shapes.

A three-dimensional, tetrahedral truss and its method of construction are provided. The truss comprises a three-dimensionally periodic skeletal array of an interconnected plurality of skeletal-tetrahedric units, the array being in the pattern of the crystallographic structure known as "cubic-diamond". Each of the skeletal-tetrahedric units is a skeletal arrangement of elongate members joined in the pattern of an equilateral skeletal tetrahedron, and is preferably assembled from four hexagonic triplanar-rings being of the form created by joining six bilateral-elements in a closed ring, triplanar pattern, the bilateral-elements each having equal sides and having an included angle of about 109.degree.28'.

This invention discloses elements for constructing a three-dimensional structure, comprising beams that make edges, polygonal plates that make faces and joints with arms that connect said beams and/or polygonal plates with each other so that a desired structure is formed, wherein the end of said joint arms is formed into a spherical shape and bearings which have a grasping means for said spherical and of said joint arms are provided to said beams and polygonal plates so that any of said bearings can be engaged or disengaged with it freely; said joints are formed into at least two shapes from an elastic material so that they can be used singly or in conjunction with the other in connecting said beams and/or polygonal plates; and hooks are provided to each side of said polygonal plates so that said hooks can hold said beams by their sides.

A loop-assembly is disclosed which is comprised of at least three scissors-pairs, at least two of the pairs comprising: two essentially identical rigid angulated strut elements each having a central and two terminal pivot points with centers which do not lie in a straight line, each strut being pivotally joined to the other of its pair by their central pivot points, each pair being pivotally joined by two terminal pivot points to two terminal pivot points of another pair in that, (a) the terminal pivot points of each of the scissors-pairs are pivotally joined to the terminal pivot points of the adjacent pair such that both scissors-pairs lie essentially in the same plane, or (b) the terminal pivot points of a scissors-pair are each pivotally joined to a hub element which is small in diameter relative to the length of a strut element, and these hub elements are in turn joined to the terminal pivot points of another scissors-pair, such that the plane that one scissors-pair lies in forms an angle with the plane that the other scissors-pair lies in, the axes passing through the pivot points of one of the scissors-pair not being parallel to the axes of the other scissors-pair, where a closed loop-assembly is thus formed of scissors-pairs, and this loop-assembly can freely fold and unfold without bending or distortion of any of its elements, and a line that intersects and is perpendicular to the axes of any two terminal pivot points is non-parallel with at least two other similarly formed lines in the assembly, the angles formed between said lines remaining constant as the loop-assembly is folded and unfolded.

A lightweight, high strength moldable structure is comprised of a core having a plurality of interconnected cavities. Each solid-walled cavity has a hexagonal base so that the core of the structure has upper and lower surfaces. Each solid-walled cavity has a unique tetrahexagonal shape in which a regular tetrahedron is located on top of and integrated with a hexagonal base. The walls of the cavities may be solid or they may be defined by a series of support struts for an even lighter weight structure. The upper and lower surfaces may be covered by skins, making it suitable for boat hulls, vacuum chambers, and aircraft. The hexagonal bases of the solid walled cavities may be replaced by perpendicular support walls extending between the adjacent tetrahedral apices and/or hexagonal base vertices.

Two tetrahedrons are fixed together at a common joint and provided with a seat fixed between faces of respective tetrahedrons and parallel to a support plane formed by two joints meeting the common joint at the common joint. For equilateral tetrahedrons which meet at an angle of 109.degree.30' between faces, plural seating can be provided by fixing three or more tetrahedrons together in a variety of configurations having a common support plane and seats parallel thereto.

A joint system having one or more tetrahedral joints formed by three edge lapped flat pieces having complimentary open-ended slots which interlock in a construction composing one vertex of a tetrahedron. A plurality of tetrahedral joints can be interconnected by one or more interlocking flat pieces having open-ended slots at both ends to form a part of two or more tetrahedral joints in various configurations with other tetrahedral joints.

A foldable dual-chair includes a pair of seat frames and a pair of back frame constructed to support a pair of fabric seats thereon respectively wherein a connecting frame is foldably supported between the two seat frames. The connecting frame includes a pair connecting leg posts each having an outer tube frame and an inner tube frame upwardly extended therefrom in a vertical movable manner. So, the connecting leg posts are capably of slidably adjusting their height in such a manner the foldable dual-chair is capable of folding up into a compact unit for easy storage and carriage.

A somewhat pyramidal underframe, for a table or chair, is folded up from a bilaterally symmetrical flat blank of sheet material. The underframes have re-entrant folds to support a like seat having a backrest and a triangular bottom, or a table top. The seat may be secured in its erected condition by applying adhesive tape to its rear spine or closing the spine with a sliding clasp fastener. On releasing the two parts of the spine, the construction may be collapsed. Blanks of kraft-lined chipboard covered with polythene can be die cut and creased in one operation. Alternatively, plywood laminated between sheets of poly-urethane foam may be used. The chairs may be clipped side-by-side to form a seating arrangement interspersed with tables According to the invention there is provided a furniture assembly comprising a central unit comprised of a formable material, a plurality of frameless seating units each comprised of a deformable material and adapted to be arranged circumferentially of the central unit, and a rigid sheet adapted to fit the upper surface of the central unit to provide a rigid upper surface for the central unit to form a table and to be used as a seating unit.

A lightweight, high strength moldable structure is comprised of a core having a plurality of interconnected cavities (12). Each solid-walled cavity (12) has a hexagonal base (24) so that the core of the structure has upper and lower surfaces. Each solid-walled cavity (12) has a unique tetrahexagonal shape in which a regular tetrahedron is located on top of and integrated with a hexagonal base (24). The walls of the cavities may be solid or they may be defined by a series of support struts (63, 64) for an even lighter weight structure. The upper and lower surfaces may be covered by skins (14, 16), making it suitable for boat hulls, vacuum chambers, and aircraft. The hexagonal bases of the solid walled cavities (12) may be replaced by perpendicular support walls (236, 242, 252) extending between the adjacent tetrahedral apices (232, 234) and/or hexagonal base vertices (254).

While these structure assemblies may be suitable for the purposes for which they were designed, they would not be as suitable for the purposes of the present invention, as hereinafter described.

SUMMARY OF THE PRESENT INVENTION

A primary object of the present invention is to provide means to construct an article of furniture comprising a plurality of rods of similar length.

Another object of the present invention is to provide means to construct an article of furniture comprising a plurality of rods of similar length forming a frame with at least one planar surface (usually two or more surfaces) for attachment thereto of covering.

Still yet another object of the present invention is to provide means to construct an article of furniture comprising a plurality of rods of similar length with said rods permanently affixed by means of welding or brazing.

Yet another object of the present invention is to provide means to construct an article of furniture comprising a plurality of rods of similar length with said rods semi-permanently affixed by means of connectors which may include other connectors already in existence.

Yet another object of the present invention is to provide means to construct an article of furniture that is easy to assemble for manufacture and cost effective for the manufacturer and the consumer.

Additional objects of the present invention will be apparent as the description proceeds.

The present invention overcomes the shortcomings of the prior art by providing a method for nearly an unlimited variety of furniture types with flexibility in design via a simple combination of polyhedra and/or parts thereof.

The foregoing and other objects and advantages will appear from the description to follow. In the description, reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the description herein. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

The following discussion describes in detail one embodiment of the invention (and several variations of that embodiment). This discussion should not be construed, however, as limiting the invention to those particular embodiments; practitioners skilled in the art will recognize numerous other embodiments as well. For definition of the complete scope of the invention, the reader is directed to appended claims.

DESCRIPTION OF THE REFERENCED NUMERALS

Figure 1:
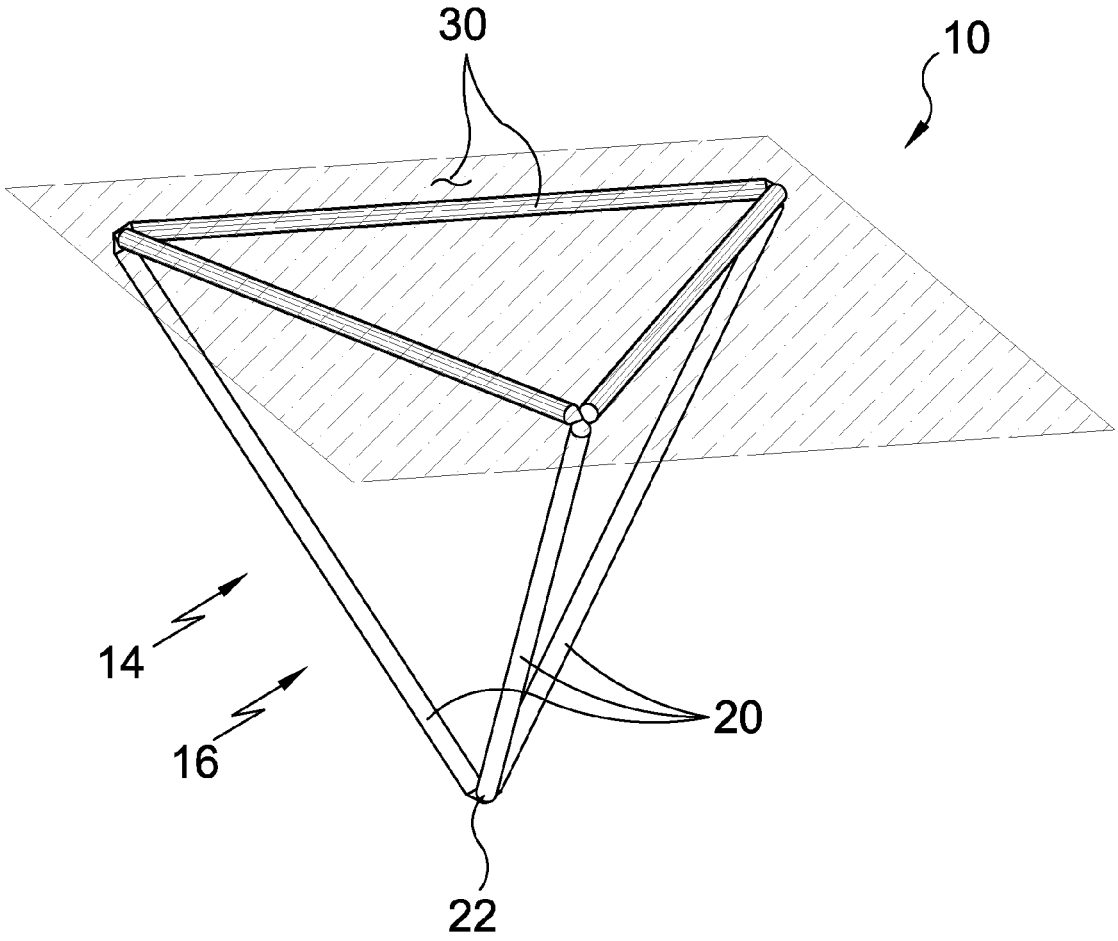
FIG. 1 is a perspective view of a tetrahedron with triangle primary surface.

Turning now descriptively to the drawings, in which reference numerals denote similar elements throughout the several views, the figures illustrate the Tetraframe Component of Furniture of the present invention. With regard to the reference numerals used, the following numbering is used throughout the various drawing figures.

10 Tetraframe Component of Furniture of the present invention
12 integrated polyhedral (namely tetrahedra and pentahedra)
14 polyhedron (4 or more sides)
16 tetrahedron (4 sided)
18 pentahedron (5 sided)
20 rods of similar length
22 distal end of rods
24 chair assembly structure
26 seat portion of 24
28 back portion of 24
30 primary planar surface
32 cushion/covering
34 triangular coplanar surface of 16 and 18
38 floor plane
40 ottoman assembly structure
42 square coplanar surface of 16 and 18
44 table assembly structure
46 square floor base of 44
48 lounge chair assembly structure
50 seat portion of 48
52 back portion of 48
54 leg support portion of 48

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is a perspective view of a tetrahedron 16 with a triangular primary planer surface 30. The present invention 10 is a component of furniture creating a frame of a polyhedron 14 and more specifically a tetrahedron 16 wherein each tetrahedron 16 is formed by a plurality of six rods 20 of similar length that are interconnected at the distal ends 22 thereof.

Figure 2:
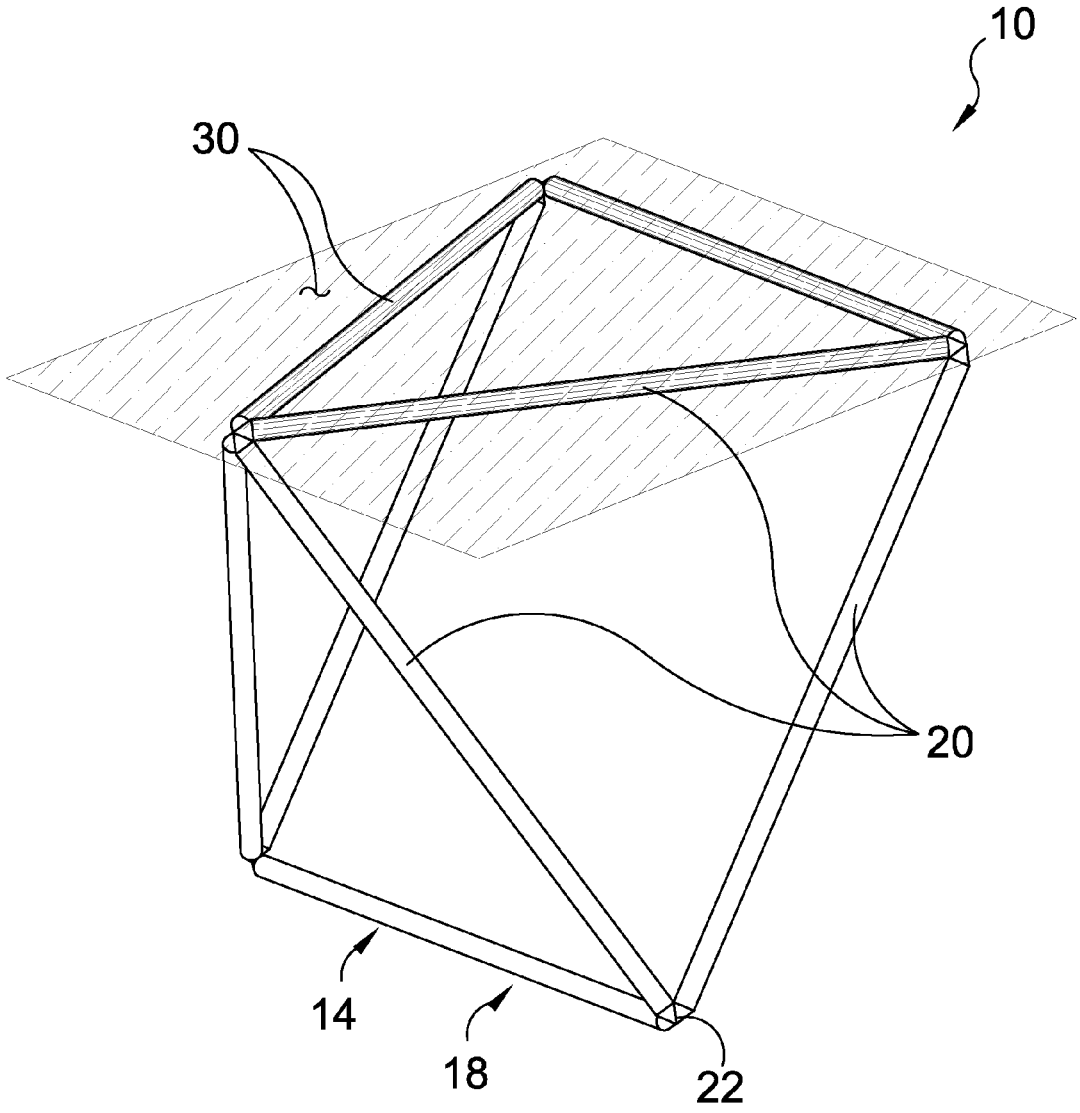
FIG. 2 is a perspective view of a pentahedron with triangle primary surface.

FIG. 2 is a perspective view of a pentahedron 18 with triangular primary planer surface 30. The present invention 10 is a component of furniture creating a frame of a polyhedron 14 and more specifically a pentahedron 18 wherein each pentahedron 18 is formed by a plurality of eight rods 20 of similar length that are interconnected at the distal ends 22 thereof.

Figure 3:
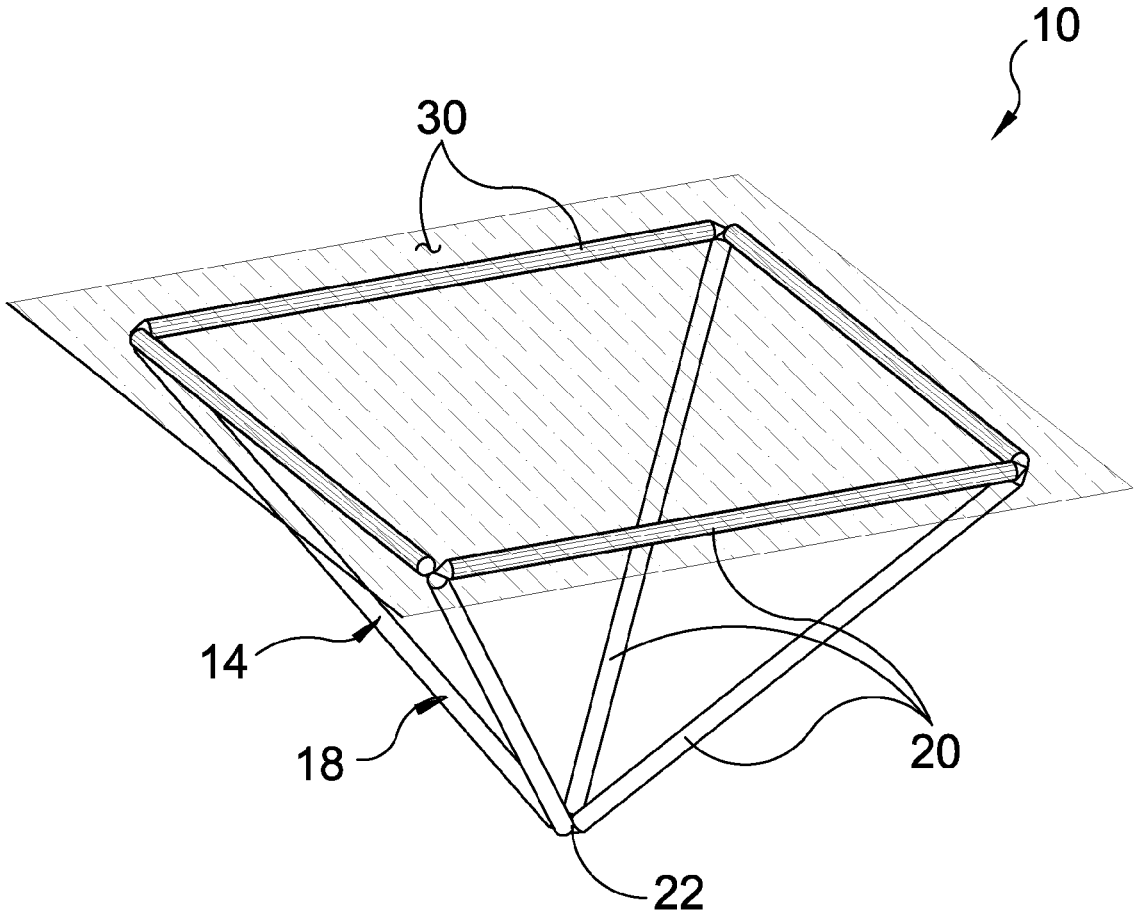
FIG. 3 is a perspective view of a pentahedron with square primary surface.

FIG. 3 is a perspective view of a pentahedron 18 with a square primary planer surface 30. The present invention 10 is a component of furniture creating a frame of a polyhedron 14 and more specifically pentahedron 18 wherein each pentahedron 18 is formed by a plurality of eight rods 20 of similar length that are interconnected at the distal ends 22 thereof.

Figure 4A:
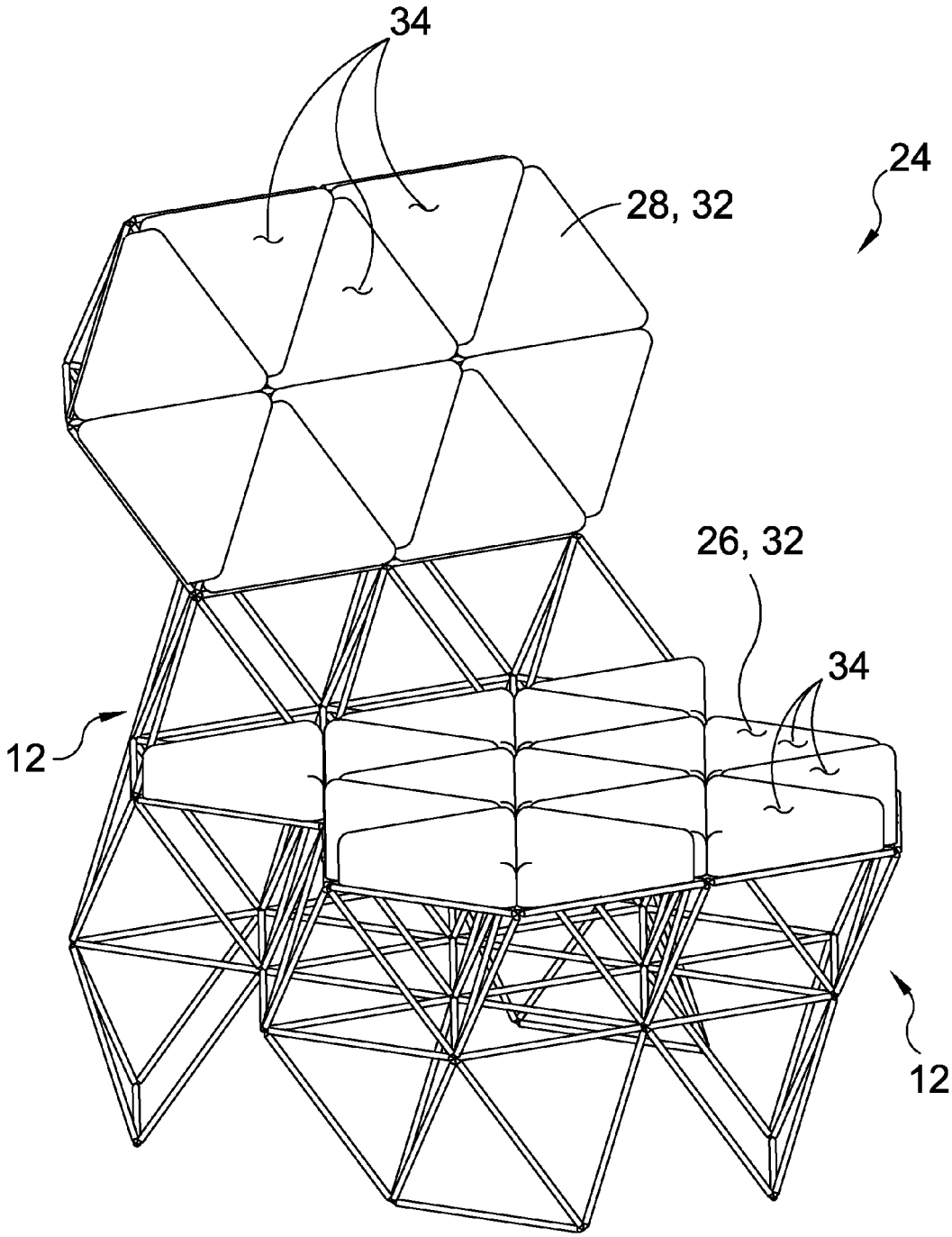
FIG. 4A is a perspective view of a chair assembly structure with cushion(s) in tetrahedra orientation with two triangle primary surfaces.

FIG. 4A is a perspective view of a chair assembly structure 24 with cushion(s) 32 in tetrahedra FIG. 1 and FIG. 2 orientation. The frame 12 makes up the back portion 28 and the seat portion 26 that are established by a plurality of polyhedra 12 with adjacent triangular coplanar surfaces 34 forming a primary planar surface for receiving a covering 32. The cushions 32 may be a single unit or a plurality of cushion segments 32 disposed on each primary planar surface 26 and 28 of the frame 12.

Figure 4B:
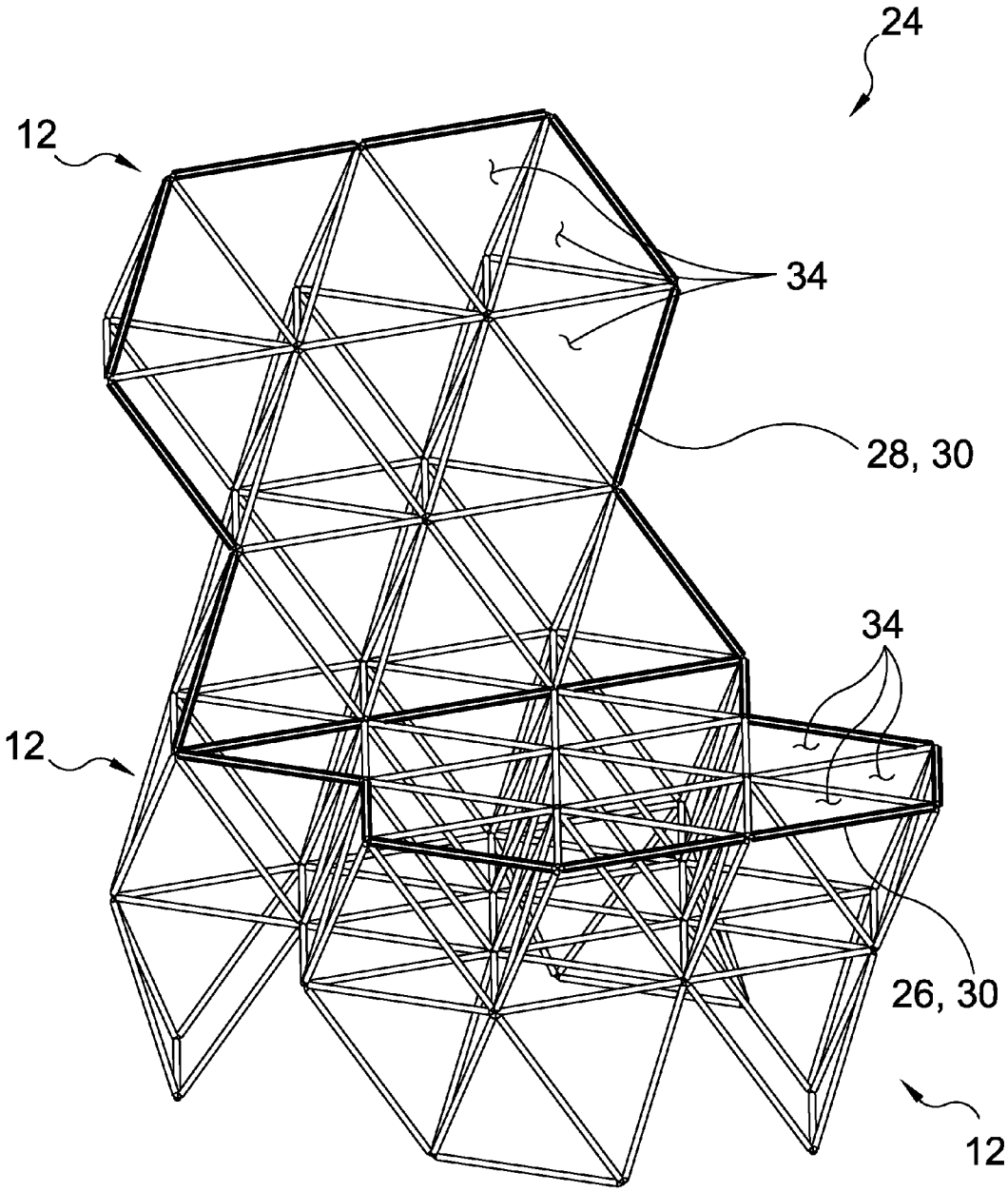
FIG. 4B is a perspective view of a chair assembly structure without cushion(s) in tetrahedra orientation with two triangle primary surfaces.

FIG. 4B is a perspective view of a chair assembly structure 24 without cushion(s) in tetrahedra FIG. 1 and FIG. 2 orientation. The frame 12 makes up the back portion 28 and the seat portion 26 that are established by a plurality of polyhedra 12 with adjacent triangular coplanar surfaces 34 forming a primary planar surface 30 as demonstrated in the illustration with the back portion 28 and the seat portion 26 darken perimeter line.

Figure 4C:
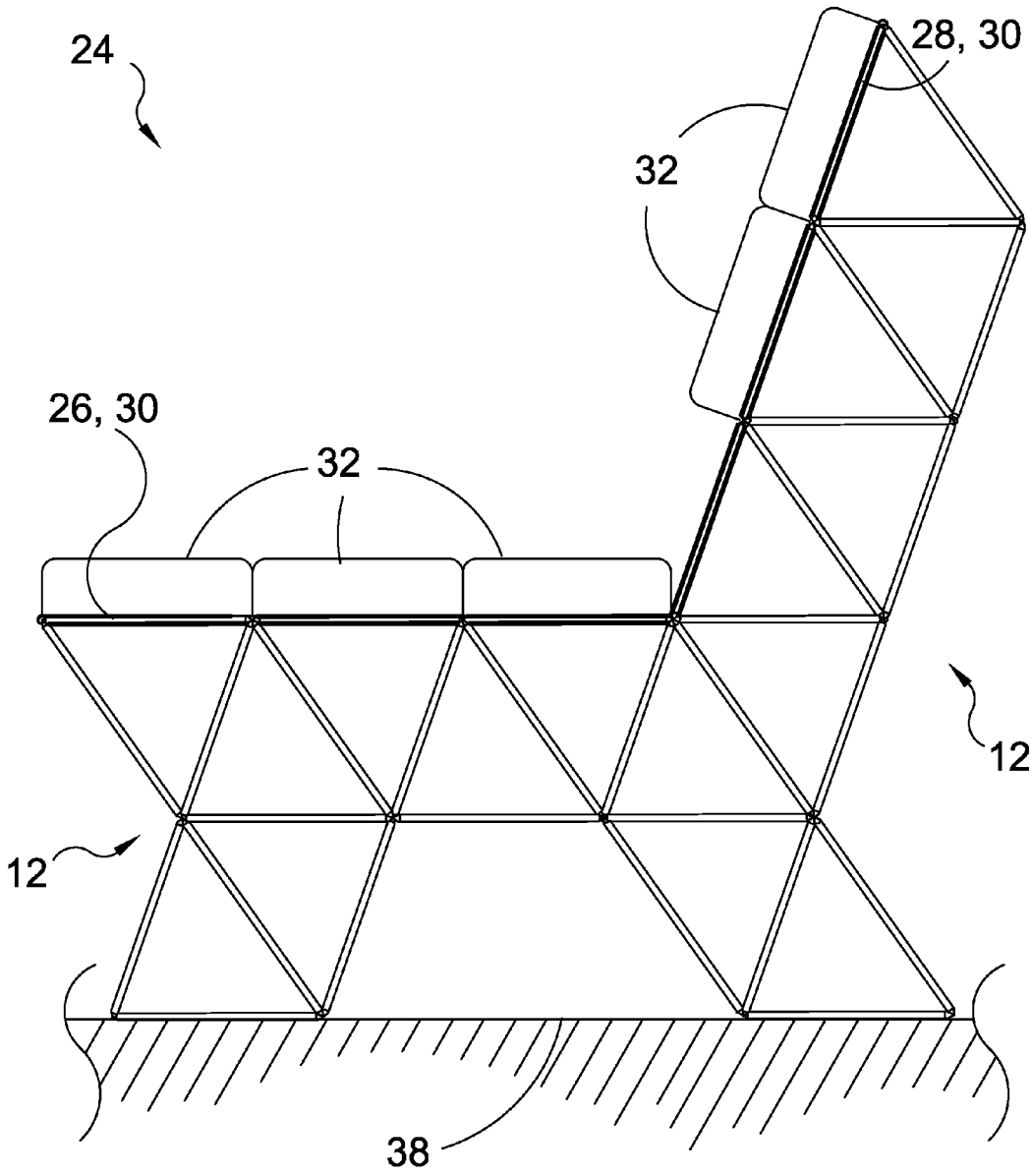
FIG. 4C is a side elevation view of a chair assembly structure with cushion(s) on seat and back plane therein and in tetrahedra orientation resting on the floor plane.

FIG. 4C is a side elevation view of a chair assembly structure 24 with cushion(s) 32 in tetrahedra FIG. 1 and FIG. 2 orientation. The frame 12 rest on the floor plane 38 with the seat planar portion 26 and the back planar portion 28 having their respective cushion(s) 32 employed therewith on the primary planer surface 30.

Figure 5A:
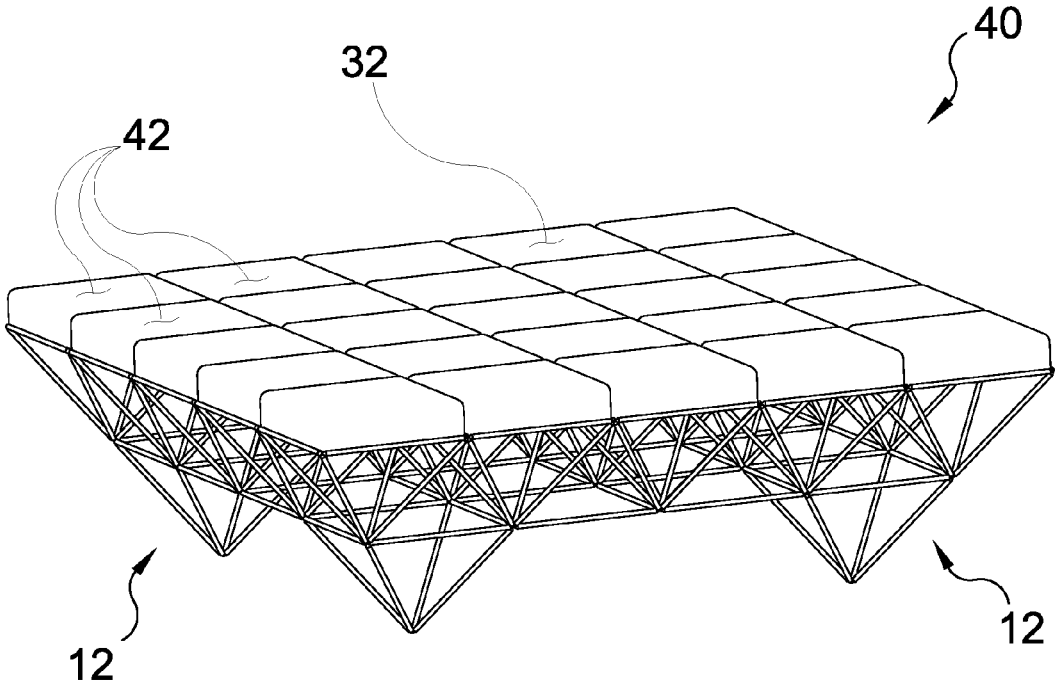
FIG. 5A is a perspective view of an ottoman assembly structure with out cushion(s) in pentahedra orientation with a square primary surface.

FIG. 5A is a perspective view of an ottoman assembly structure 40 with cushion(s) 32 in pentahedra FIG. 3 orientation. The frame 12 creates the seat portion of the square coplanar surfaces 42.

Figure 5B:
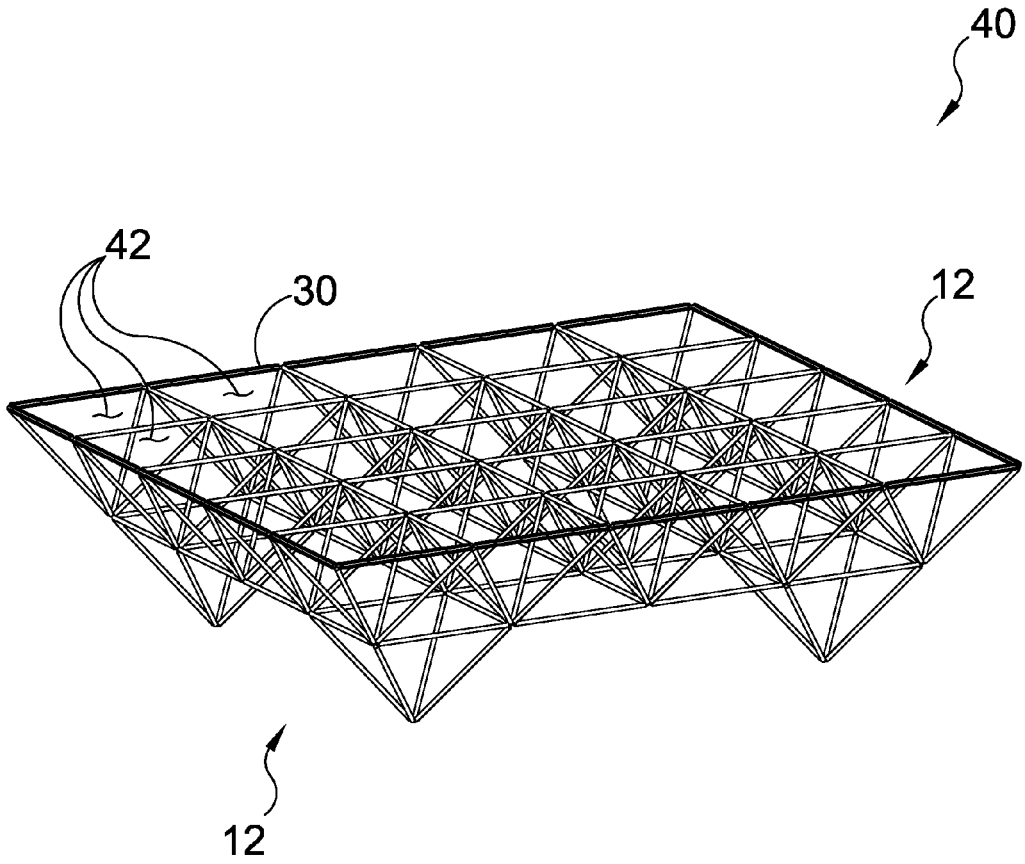
FIG. 5B is a perspective view of an ottoman assembly structure without cushion(s) in pentahedra orientation with a square primary surface.

FIG. 5B is a perspective view of an ottoman assembly structure 40 without cushion(s) in pentahedra FIG. 3 orientation. The frame 12 creates the seat portion of the square coplanar surfaces 42, and establish the primary planar surface 30 as demonstrated in the illustration with the seat portion darken perimeter line.

Figure 5C:
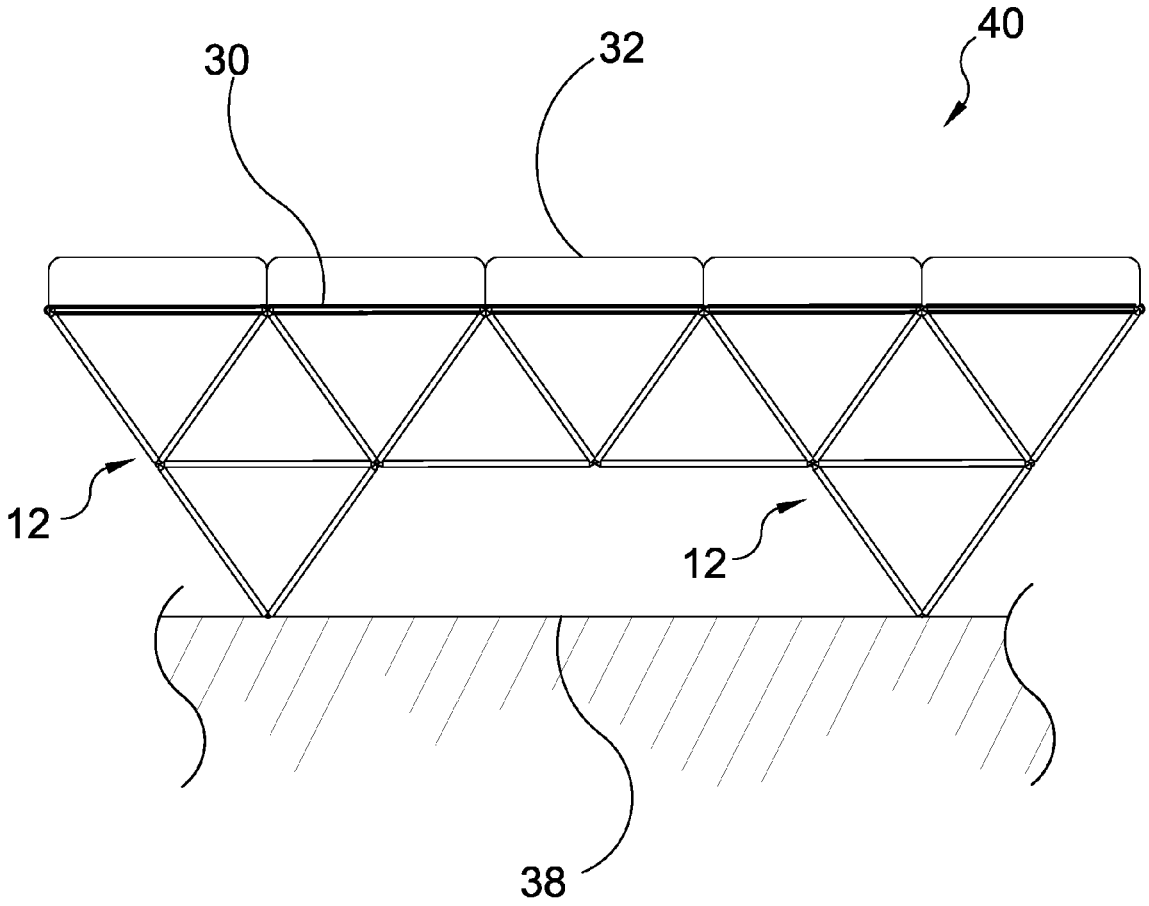
FIG. 5C is a side elevation view of an ottoman assembly structure with cushion(s) on top plane therein and in pentahedra orientation resting on floor plane.

FIG. 5C is a side elevation view of an ottoman assembly structure 40 with cushion(s) 32 in pentahedra FIG. 3 orientation. The frame 12 is shown resting on the floor plane 38 with seat primary planer surface 30 as demonstrated in the illustration with the darken perimeter line.

Figure 6A:
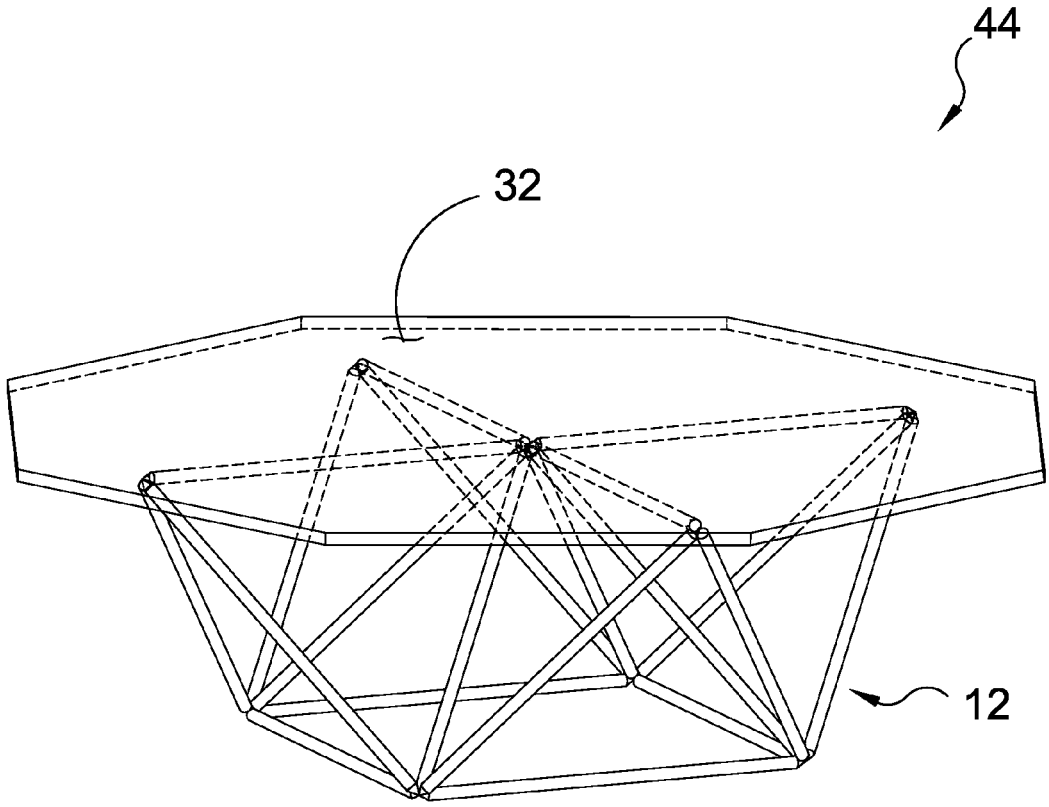
FIG. 6A is a perspective view of a table assembly structure with top cover in inverted pentahedron orientation with a segmented square primary surface.

FIG. 6A is a perspective view of a table assembly structure 44 with top cover 32 in pentahedra FIG. 3 orientation. The inverted pentahedron FIG. 3 is configured to form a frame 12 for supporting a covering 32 used as a tabletop.

Figure 6B:
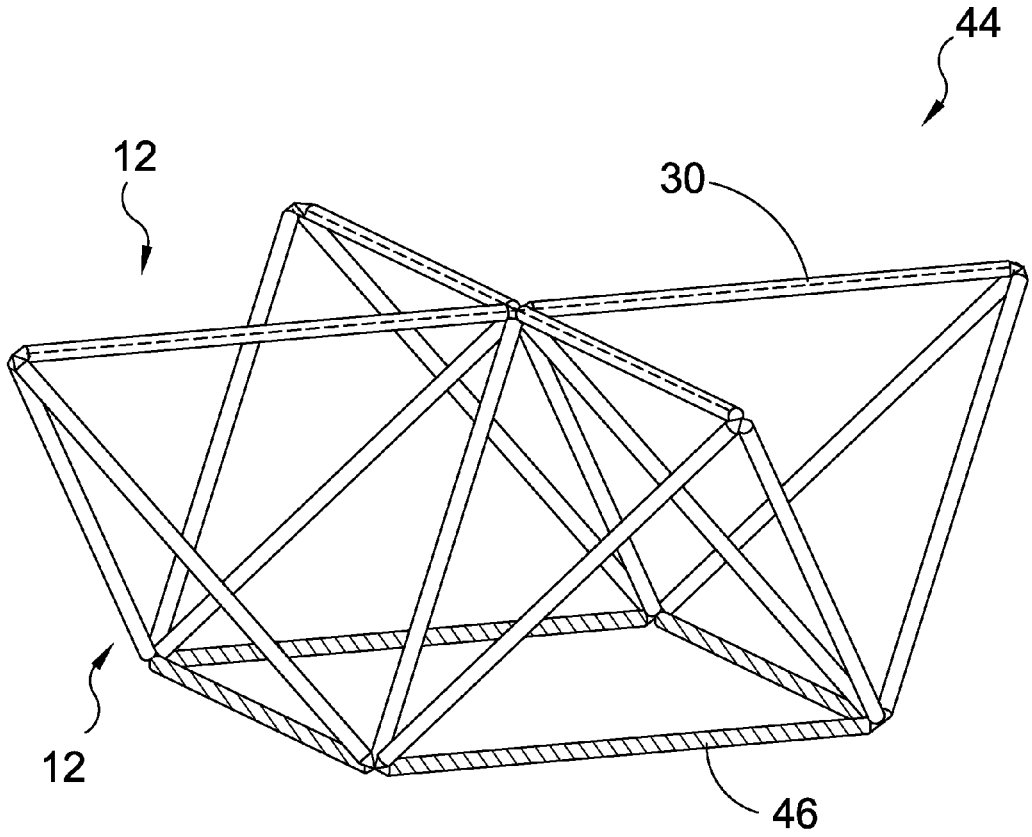
FIG. 6B is a perspective view of a table assembly structure without top cover in inverted pentahedron orientation with a segmented square primary surface.

FIG. 6B is a perspective view of a table assembly structure 44 without top cover in pentahedra FIG. 3 orientation. The inverted pentahedron FIG. 3 is configured to form a frame 12 having a square floor base 46 as illustrated with diagonal lines, for supporting a covering used as a tabletop as illustrated with dashed lines 30.

Figure 6C:
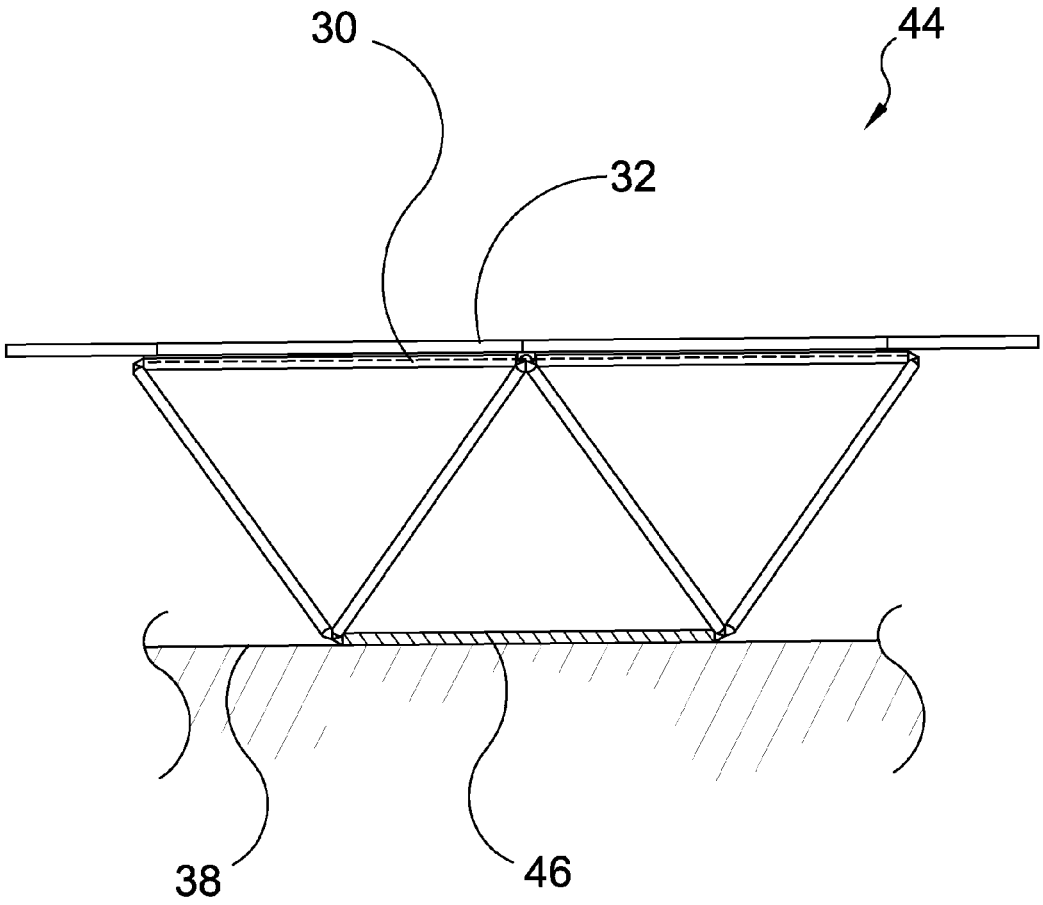
FIG. 6C is a side elevation view of a table assembly structure with top cover on inverted pentahedron resting on floor plane.

FIG. 6C is a side elevation view of a table assembly structure 44 with top cover 32 in pentahedra FIG. 3 orientation. The inverted pentahedron FIG. 3 is configured to form a frame 12 having a square floor base 46 as illustrated with diagonal lines to rest on the floor plane 38 with the top cover 32 to rest on the resulting tetrahedra FIG. 1 as illustrated with dashed lines 30.

Figure 6D:
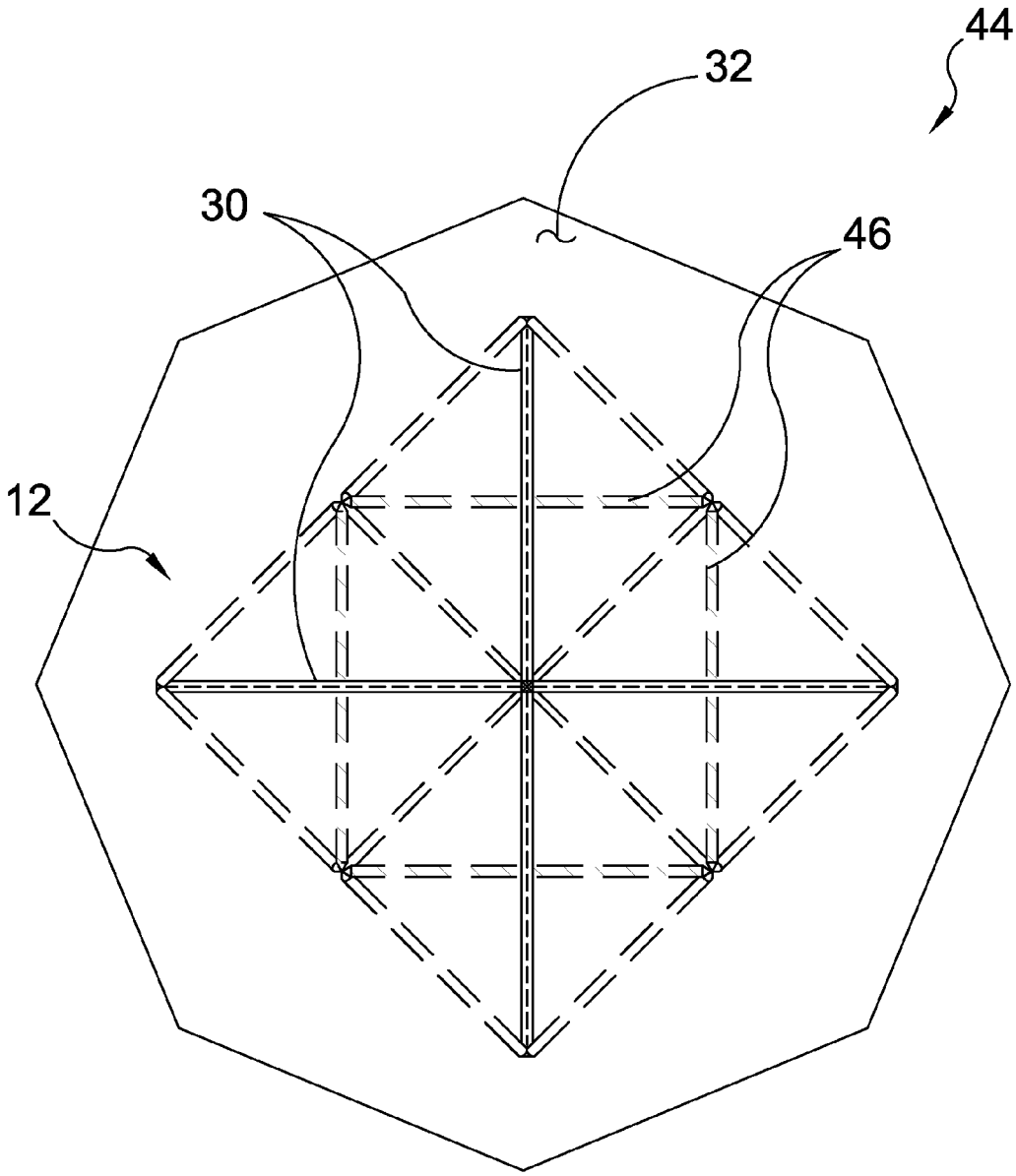
FIG. 6D is a plan view of a table assembly structure with top cover on inverted pentahedron resting on floor plane.

FIG. 6D is a plan view of a table assembly structure 44 with top cover 32 in pentahedra FIG. 3 orientation. The inverted pentahedron FIG. 3 is configured to form a frame 12 having a square floor base 46 as illustrated with diagonal lines, for supporting a covering used as a table top as illustrated with dashed lines 30.

Figure 7A:
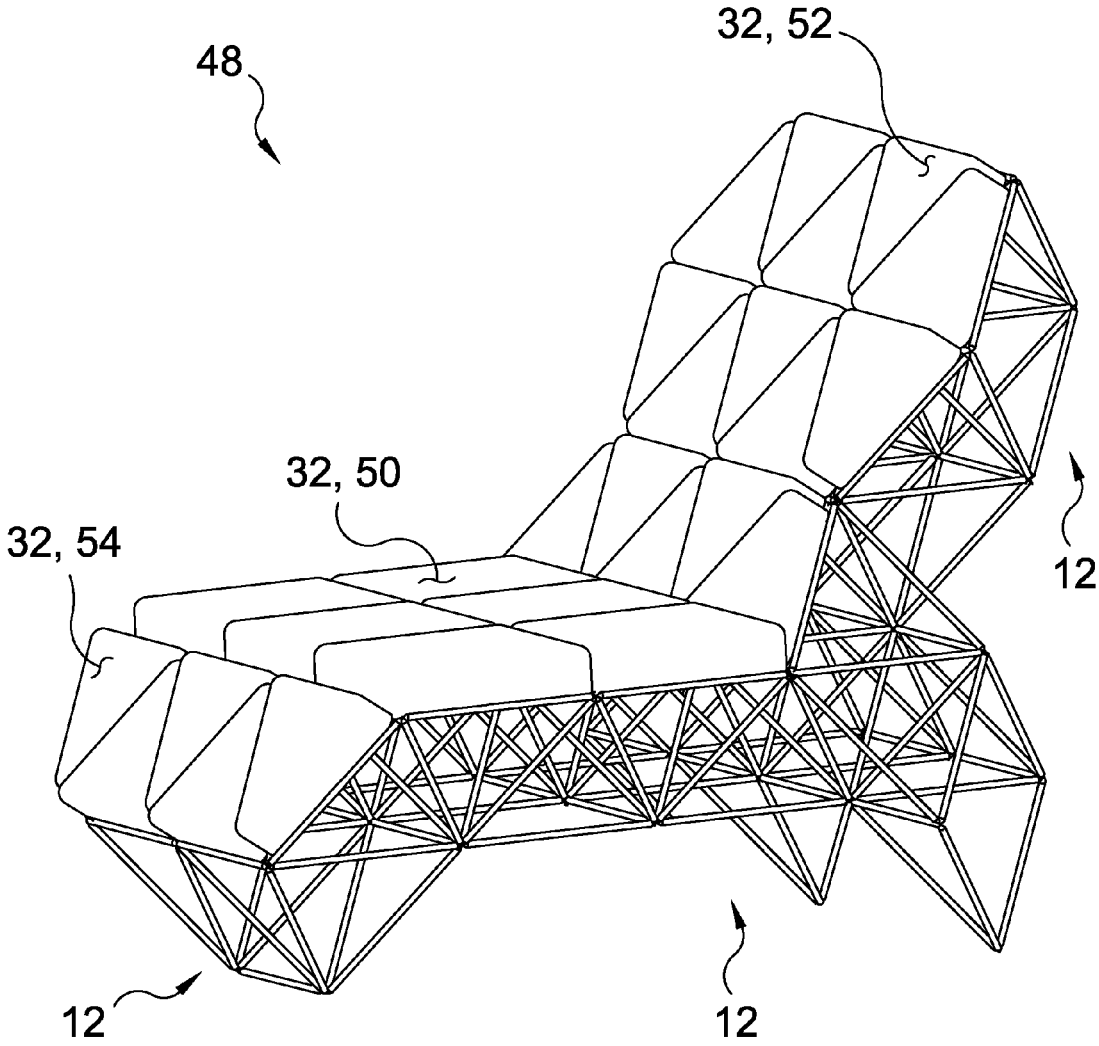
FIG. 7A is a perspective view of a lounge chair assembly structure with cushion(s) in combination of tetrahedra/pentahedra orientation with both triangle and square primary surfaces.

FIG. 7A is a perspective view of a lounge chair assembly structure 48 with cushion(s) 32 in combination of tetrahedra FIG. 1 and pentahedra FIG. 2 and FIG. 3 orientation. The structure has a frame 12 that supports the seat portion 50, the back portion 52 and leg support portion 54.

Figure 7B:
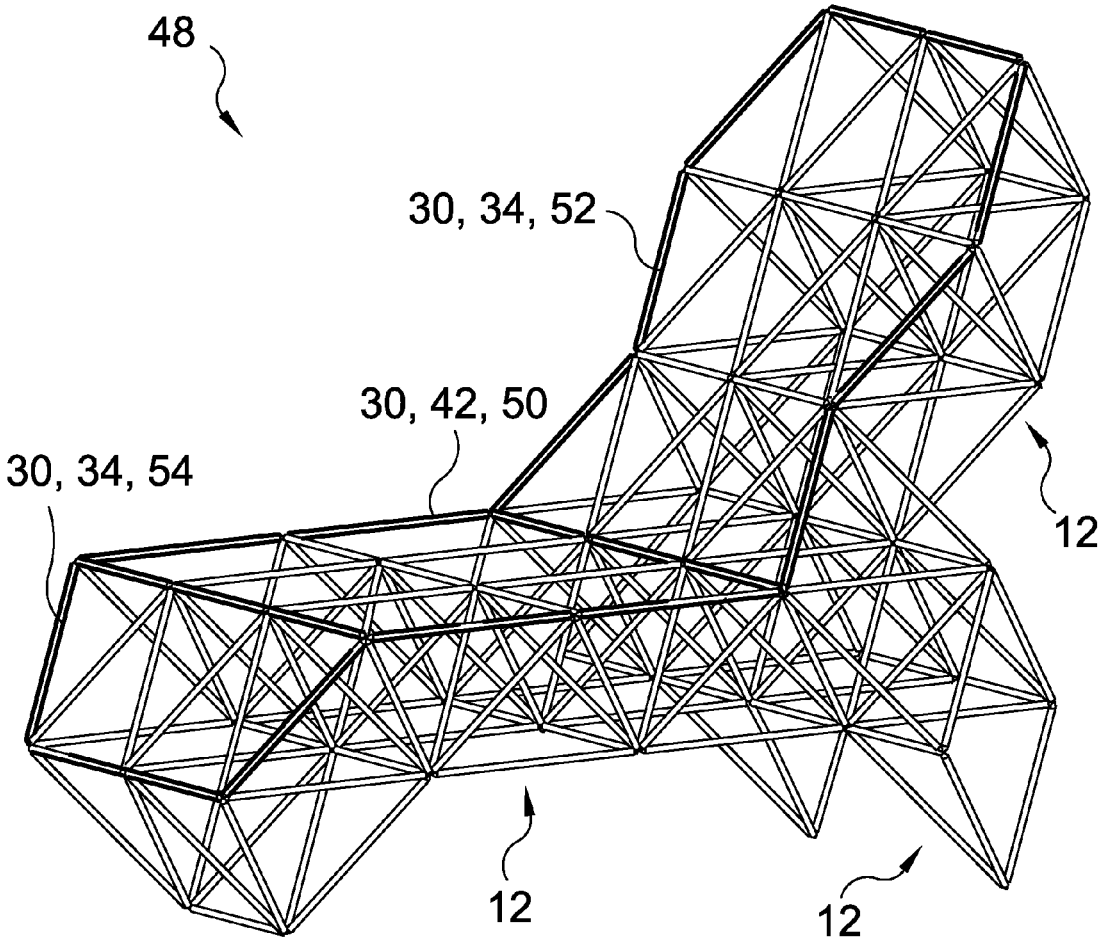
FIG. 7B is a perspective view of a lounge chair assembly structure without cushion(s) in combination of tetrahedra/pentahedra orientation with both triangle and square primary surfaces.

FIG. 7B is a perspective view of a lounge chair assembly structure 48 without cushion(s) in combination of tetrahedra FIG. 1 and pentahedra FIG. 2 and FIG. 3 orientation. The structure has a frame 12 that support the seat portion 42, 50, the back portion 34, 52 and leg support portion 34, 54. Additionally, the seat portion, back portion and leg portion 30 are illustrated with darken perimeter lines.

Figure 7C:
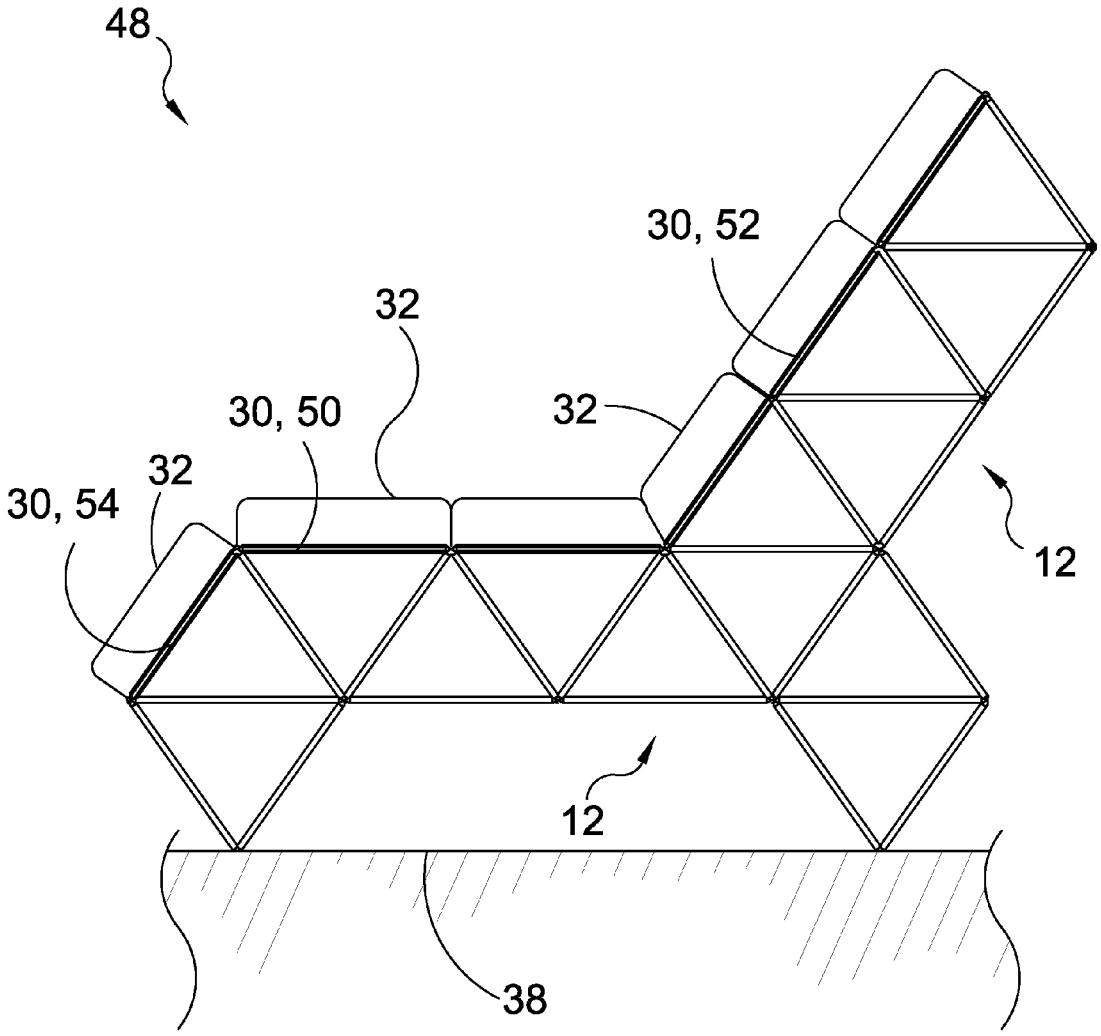
FIG. 7C is a side elevation view of a lounge chair assembly structure with cushion(s) on seat, back and leg portion of frame, resting on floor plane.

FIG. 7C is a side elevation view of a lounge chair assembly structure 48 with cushion(s) 32 in combination of tetrahedra FIG. 1 and pentahedra FIG. 2 and FIG. 3 orientation. The structure 12 supports the seat 30, 50; the back 30, 52; the leg support 30, 54 and rest on floor plane 38.

It will be understood that each of the elements described above, or two or more together may also find a useful application in other types of configurations differing from the type described above.

While certain novel features of this invention have been shown and described and are pointed out in the annexed claims, it is not intended to be limited to the details above, since it will be understood that various omissions, modifications, substitutions and changes in the forms and details of the structures illustrated and in its operation can be made by those skilled in the art without departing in any way from the spirit of the present product development.

Without further analysis, the foregoing will so fully reveal the sum and substance of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An article of furniture, the article of furniture comprising:

a frame having a plurality of interconnected tetrahedra and pentahedra, said tetrahedra and pentahedra being formed from a plurality of connected struts, said struts only connected at distal ends thereof;

said tetrahedra and pentahedra interconnected to form at least one primary planar surface formed from a plurality of coplanar struts;

said plurality of coplanar struts forming a plurality of coplanar shapes selected from the group consisting of triangular and square; and a covering attached to said at least one primary planar surface.

2. The article of furniture recited in claim 1, wherein said coplanar shapes are triangular in orientation.

3. The article of furniture recited in claim 1, wherein said coplanar shapes are square in orientation.

4. The article of furniture recited in claim 1, wherein said distal ends of said rods are permanently connected.

5. The article of furniture recited in claim 4, wherein said distal ends of said rods are connected by means selected from appropriate methods including welding and brazing.

6. The article of furniture recited in claim 1, wherein said distal ends of said rods are semi-permanently connected.

7. The article of furniture recited in claim 1, wherein said covering comprises a plurality of covering segments, each covering segment having substantially the same shape and size as the coplanar shape to which it is attached.

8. The article of furniture recited in claim 1, wherein said article of furniture has a single, primary planar surface.

9. The article of furniture recited in claim 8, wherein said article of furniture is an ottoman.

10. The article of furniture recited in claim 8, wherein said article of furniture is a table.

11. The article of furniture recited in claim 1, wherein said article of furniture has a plurality of primary planar surfaces.

12. The article of furniture recited in claim 11, wherein said article of furniture is a chair having one primary planar surface as a seat portion and one primary planar surface as a back portion.

13. The article of furniture recited in claim 11, wherein said article of furniture is a lounge chair having one primary planar surface as a seat portion, one primary planar surface as a back portion and one primary planar surface as a leg support.

14. The article of furniture recited in claim 8, wherein said polyhedra are pentahedra and said coplanar surface forming said primary planar surfaces of said pentahedra are square in orientation.

15. The article of furniture recited in claim 13, wherein said coplanar shapes of said seat portion are square in orientation.

16. The article of furniture recited in claim 15, wherein said coplanar shapes of said back portion are triangular in orientation.

17. An article of furniture, the article of furniture comprising:

a frame having a plurality of interconnected tetrahedra and pentahedra, said tetrahedra and pentahedra being formed from a plurality of connected struts, said struts only connected at distal ends thereof;

said tetrahedra and pentahedra interconnected to form at least one primary planar surface formed from a plurality of coplanar struts;

said plurality of coplanar struts forming a plurality of coplanar shapes; and a plurality of coverings attached to said at least one primary planar surface such that there is a covering over each of said plurality of coplanar shapes; and the shape of each covering and its respective coplanar shape being substantially the same.

18. The article of furniture recited in claim 17, wherein said coplanar shapes are triangular in orientation.

19. The article of furniture recited in claim 17, wherein said coplanar shapes are square in orientation.

20. The article of furniture recited in claim 17, wherein said distal ends of said struts are permanently connected.

21. The article of furniture recited in claim 20, wherein said distal ends of said struts are connected by means selected from appropriate methods including welding and brazing.

22. The article of furniture recited in claim 17, wherein said distal ends of said struts are semi-permanently connected.

* * * * *